US009958822B2

(12) United States Patent
Yamamoto

(10) Patent No.: US 9,958,822 B2
(45) Date of Patent: May 1, 2018

(54) ELECTRICAL CONNECTING MEMBER AND IMAGE FORMING APPARATUS

(71) Applicant: KYOCERA Document Solutions Inc., Osaka (JP)

(72) Inventor: Kiyonori Yamamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days. days.

(21) Appl. No.: 15/413,894

(22) Filed: Jan. 24, 2017

(65) Prior Publication Data

US 2017/0248892 A1 Aug. 31, 2017

(30) Foreign Application Priority Data

Feb. 25, 2016 (JP) ..... 2016-034103

(51) Int. Cl.
*G03G 15/00* (2006.01)
*H01R 13/17* (2006.01)

(52) U.S. Cl.
CPC ..... *G03G 15/80* (2013.01); *H01R 13/17* (2013.01)

(58) Field of Classification Search
USPC .... 399/75, 90, 107, 110, 111, 112, 116, 117, 399/167
See application file for complete search history.

(56) References Cited

U.S. PATENT DOCUMENTS 6,029,019 A 2/2000 Kawai
7,711,282 B2 * 5/2010 Okabe ..... G03G 21/1867 399/112
8,902,266 B2 12/2014 Aoi
8,995,866 B2 * 3/2015 Itabashi ..... G03G 21/1864 399/111
9,581,960 B2 * 2/2017 Hashimoto ..... G03G 21/1867

FOREIGN PATENT DOCUMENTS

JP H10-301350 A 11/1998
JP 2014-071219 A 4/2014

* cited by examiner

*Primary Examiner* — Hoan Tran
(74) *Attorney, Agent, or Firm* — Studebaker & Brackett PC

(57) ABSTRACT

An electrical connecting member electrically connects between two conductive members. The electrical connecting member includes a coil spring part formed by winding a wire around a coil axis. The electrical connecting member comes into contact with one of the conductive members with elastic force in a circumferential direction around the coil axis and comes in contact with the other of the conductive members with elastic force in an axial direction of the coil axis so that the conductive members are electrically connected.

6 Claims, 6 Drawing Sheets

ELECTRICAL CONNECTING MEMBER AND IMAGE FORMING APPARATUS

INCORPORATION BY REFERENCE

This application is based on and claims the benefit of priority from Japanese Patent application No. 2016-034103 filed on Feb. 25, 2016, which is incorporated by reference in its entirety.

BACKGROUND

The present disclosure relates to an electrical connecting member which electrically connects between conductive members and an image forming apparatus having the electrical connecting member.

In an image forming apparatus, such as a printer and a copying machine, in order to electrically connect between various conductive members or ground a conductive member, an electrical connecting member using a spring member is sometimes employed.

Such a spring member includes a plate spring or a torsion coil spring. In a case of the plate spring, bent portions are formed on both ends of the plate spring and then one bent portion is connected to one conductive member while the other bent portion comes in contact with the other conductive member. In a case of the torsion coil spring, two arm portions are respectively engaged with two conductive members.

However, in the case of the plate spring, a structure of the bent portions becomes complicate depending on a position of the conductive members. Thus, the electrical connecting member may increase in cost and size. In the case of the torsion coil spring, it is required to engage the arm portions as twisted with the conductive members. Thus, a mounting work of the electrical connecting may not be smoothly carried out.

SUMMARY

In accordance with an embodiment of the present disclosure, an electrical connecting member electrically connects between two conductive members. The electrical connecting member includes a coil spring part formed by winding a wire around a coil axis. The electrical connecting member comes into contact with one of the conductive members with elastic force in a circumferential direction around the coil axis and comes in contact with the other of the conductive members with elastic force in an axial direction of the coil axis so that the conductive members are electrically connected.

In accordance with an embodiment of the present disclosure, an image forming apparatus includes a drum unit, a supporting plate and an electrical connecting member. The drum unit supports an image carrier rotatably around a rotating shaft. To the supporting plate, the drum unit is detachably attached. The electrical connecting member electrically connects between the rotating shaft and the supporting plate. The electrical connecting member has a coil spring part formed by winding a wire around a coil axis. The electrical connecting member comes in contact with the rotating shaft with elastic force in a circumferential direction around the coil axis and comes in contact with the supporting plate with elastic force in an axial direction of the coil axis so that the rotating shaft and the supporting frame are electrically connected.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to figures, an electrical connecting member and an image forming apparatus according to an embodiment of the present disclosure will be described.

Figure 1:
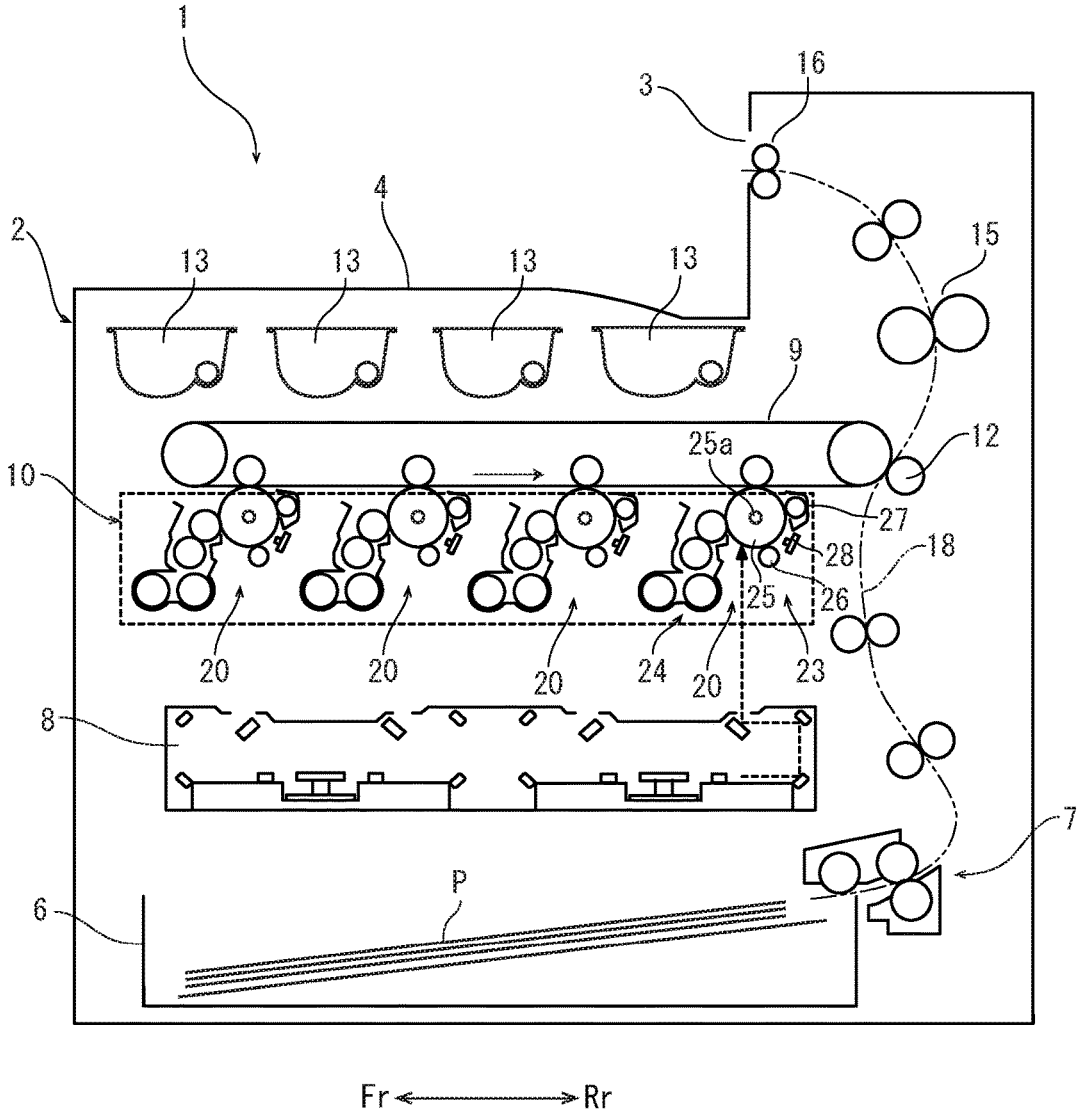
FIG. 1 is a sectional view schematically showing an internal structure of a color printer according to an embodiment of the present disclosure.

With reference to FIG. 1, a color printer 1 that is an image forming apparatus will be described. FIG. 1 is a perspective view showing the color printer. In the following description, a left side on the paper plan of FIG. 1 shows a front side of the color printer 1, and left and right directions are based on a direction in which the color printer 1 is viewed from the front side. In each figure, Fr, Rr, L and R show a front side, a rear side, a left side and a right side, respectively.

The color printer 1 has a substantially rectangular parallelepiped shaped apparatus main body 2. On an upper face of the apparatus main body 2, an ejection port 3 through which a sheet P with a formed image is ejected and an ejection tray 4 disposed below the ejection port 3 are formed. In a lower portion of the apparatus main body 2, a sheet feeding cassette 6 in which the sheet P is stored and a sheet feeding device 7 which feeds the sheet P from the sheet feeding cassette 6 are installed. Above the sheet feeding cassette 6, an exposure device 8 is installed, and above the exposure device 8, an intermediate transferring belt 9 is supported so as to circulate and run. Below the intermediate transferring belt 9, a process unit 10 is detachably installed. The process unit 10 forms a full color toner image on the intermediate transferring belt 9 using toner of four colors in an electrophotographic manner. The process unit 10 is connected to toner containers 13 each containing the toner of each color.

On the rear side of the intermediate transferring belt 9, a second transferring roller 12 is rotatably supported. Above the second transferring roller 12, a fixing device 15 is installed. Above the fixing device 15, an ejection device 16 is installed inside of the ejection port 3. Inside of the apparatus main body 2, a conveying path 18 for the sheet P is formed from the sheet feeding device 7 to the ejection device 16 through the second transferring roller 12 and the fixing device 15.

Next, an image forming operation of the color printer 1 having the above described configuration will be described. First, based on an image date exposed by the exposure device 8, the process unit 10 forms a full color toner image on the intermediate transferring belt 9. On the other hand, the sheet P fed from the sheet feeding cassette 6 by the sheet feeding device 7 is conveyed along the conveying path 18 in a suitable timing. Then, the full color image on the intermediate transferring belt 9 is transferred on the sheet P by the second transferring roller 12. The sheet P on which the full color toner image has been transferred is conveyed into the fixing device 15 and the full color toner image is fixed on the sheet P. The sheet P with the fixed full color toner image is ejected by the ejection device 16 from the ejection port 3 on the ejection tray 4.

Figure 2:
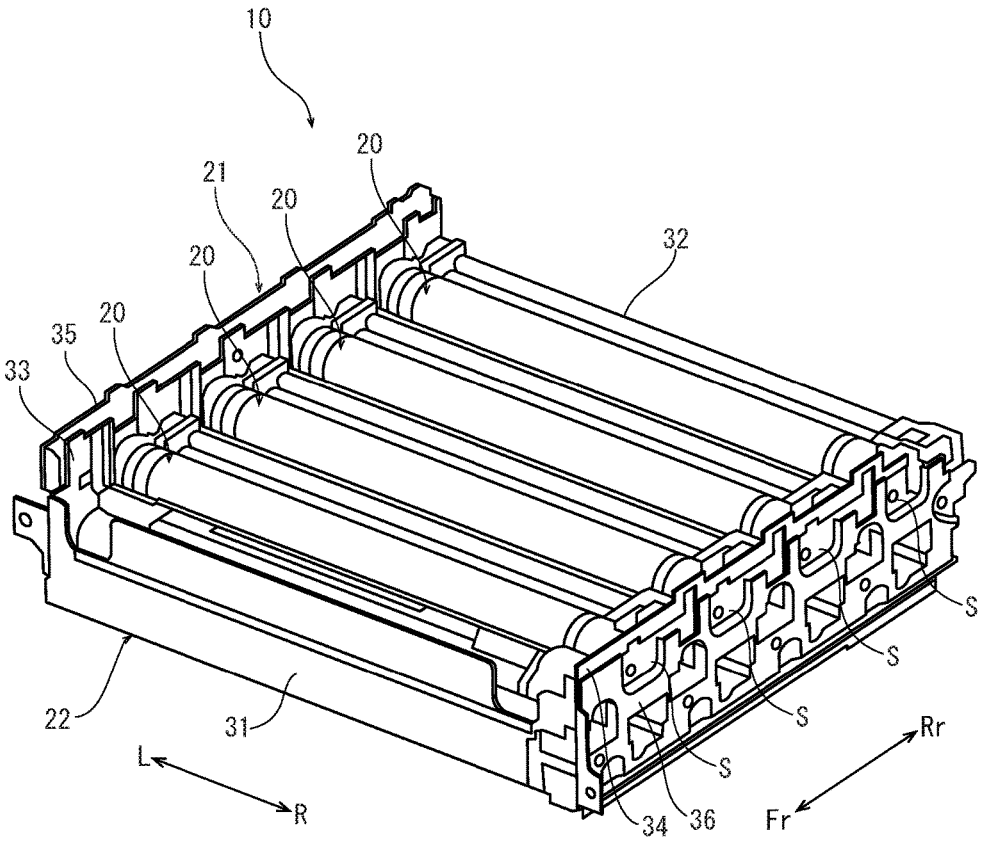
FIG. 2 is a perspective view showing a process unit, in the color printer according to the embodiment of the present disclosure.

Next, the process unit 10 will be described with reference to FIGS. 1 and 2. FIG. 2 is a perspective view showing the process unit.

As shown in FIG. 2, the process unit 10 includes four image forming units 20 and a process frame 21 to which the image forming units 20 are detachably attached. As shown in FIG. 1, the image forming unit 20 has a drum unit 23 and a development unit 24. The drum unit 23 has a photosensitive drum 25 that is an image carrier which is rotatable around a rotating shaft 25*a* made of metal. The drum unit 23 further has a charging device 26, a cleaning device 27 and an eliminating device 28 which are arranged around the photosensitive drum 25 in the order along a rotating direction of the photosensitive drum 25. The development unit 24 is positioned so as to face the photosensitive drum 25 on a downstream side of the charging device 26 in the rotating direction of the photosensitive drum 25.

In each image forming unit 20, after charged by the charging device 26 and then exposed by the exposure device 8, a latent image based on the image date is formed on an surface of the photosensitive drum 25. The latent image is developed into a toner image of corresponding color by the development unit 24 and the toner image is transferred on the intermediate transferring belt 9. By transferring the toner image of each image forming unit 20, a full color toner image is formed on the intermediate transferring belt 9. The toner and charge remained on the photosensitive drum 25 are respectively removed by the cleaning device 27 and the eliminating device 28.

As shown in FIG. 2, the process frame 21 has a substantially square cylinder shaped frame main body 22 and left and right sideplate 35 and 36 that are conductive supporting plates. The frame main body 22 has a front wall 31 and a rear wall 32 which oppose to each other in the front and rear directions, a left side wall 33 and a right side wall 34 which oppose to each other in the left and right directions, and is formed into a square cylindrical shape. The left sideplate 35 is fastened to an outer face of the left side wall 33 by screws. The right side plate 36 is fastened to an outer face of the right side wall 34 by screws. The frame main body 22 is made of resin material, and the left and right side plates 35 and 36 are made of conductive material, such as sheet metal. On each of the left and right side walls 33 and 34 and each of the left and right side plates 35 and 36, an attachment section S to which each image forming unit 20 is attached are adjacently formed along the front and rear direction. When the process unit 10 is installed to the apparatus main body 2, the left and right side plates 35 and 36 are grounded through the apparatus main body 2.

Figure 3:
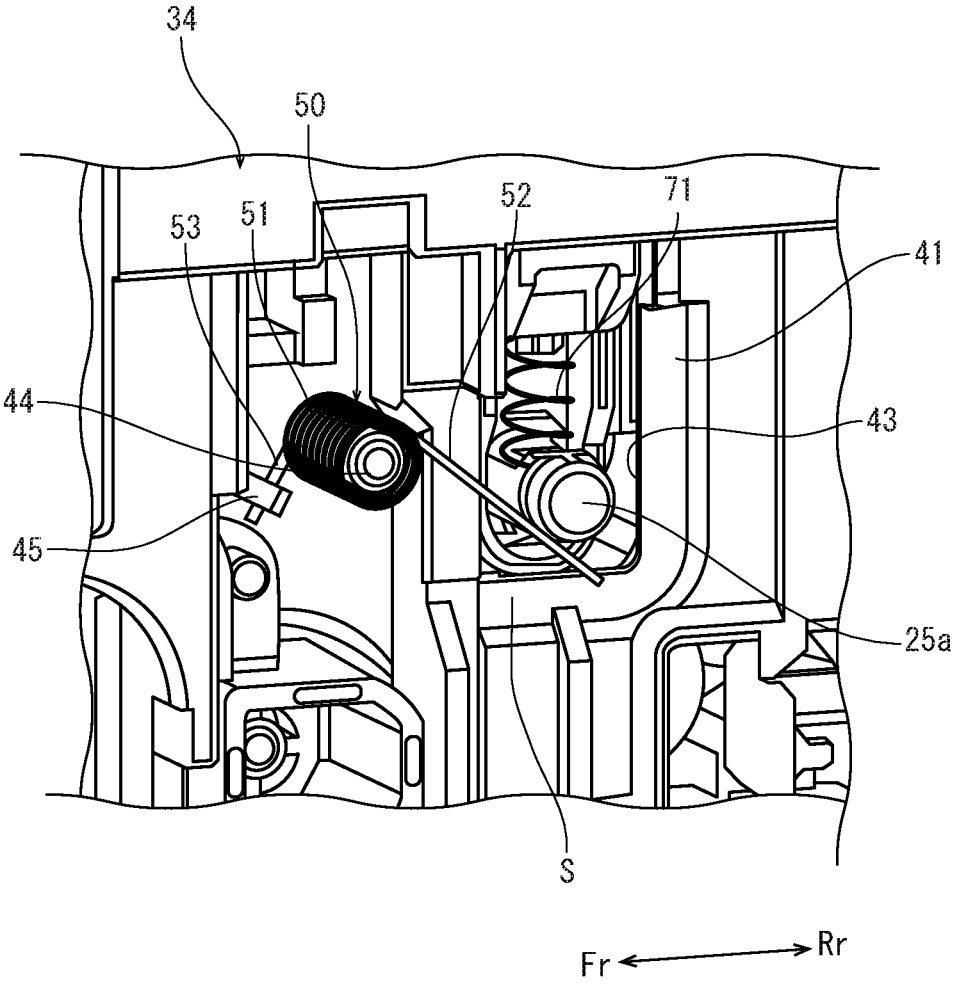
FIG. 3 is a perspective view showing an attachment section of a right side wall of the process unit, in the color printer according to the embodiment of the present disclosure.
Figure 4:
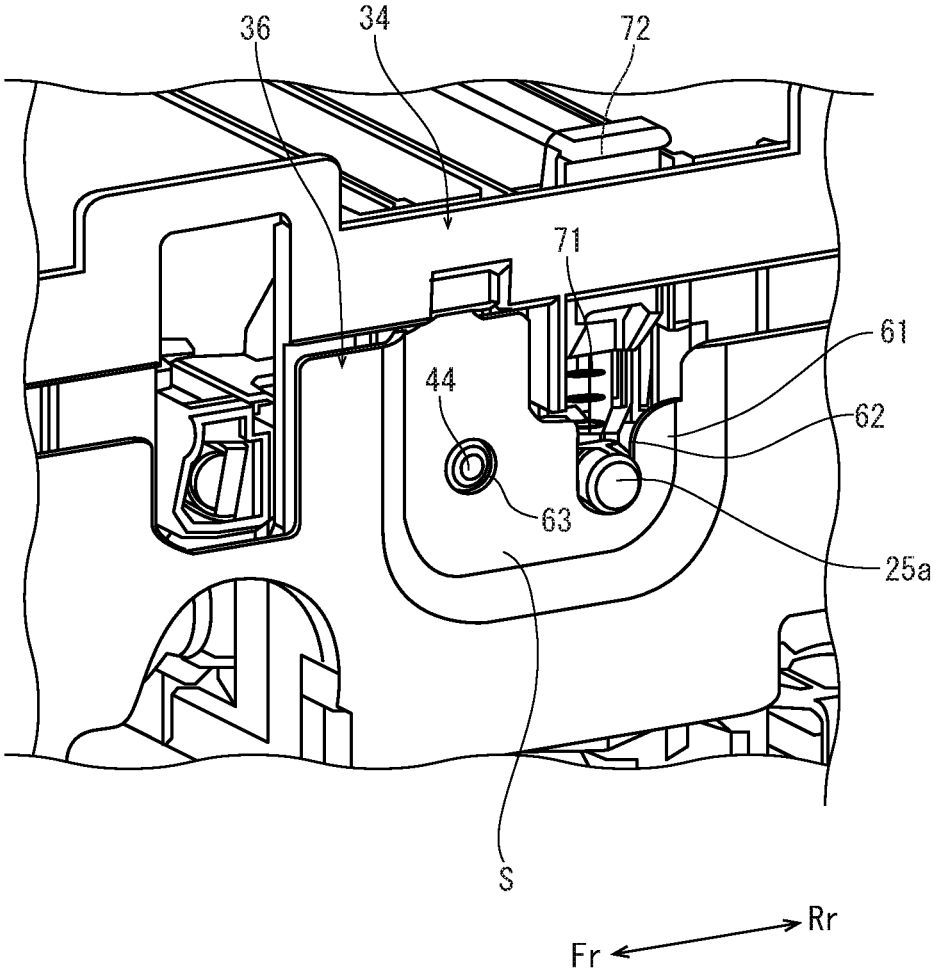
FIG. 4 is a perspective view showing an attachment section of a right side plate of the process unit, in the color printer according to the embodiment of the present disclosure.
Figure 5A:
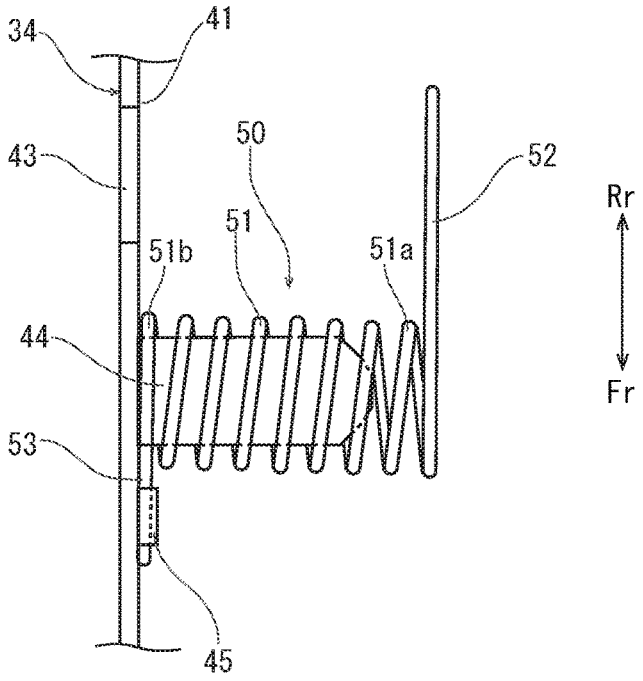
FIG. 5A is a plan view showing an electrical connecting member supported in the right side wall, in the color printer according to the embodiment of the present disclosure.
Figure 5B:
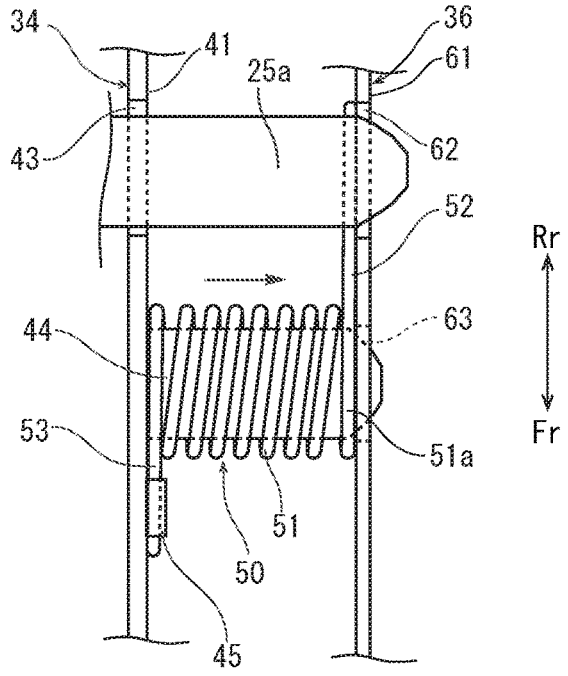
FIG. 5B is a plane view showing the electrical connecting member compressed in an axial direction of a coil axis and in a circumferential direction around the coil axis between the right side wall and the right side plate, in the color printer according to the embodiment of the present disclosure.
Figure 6A:
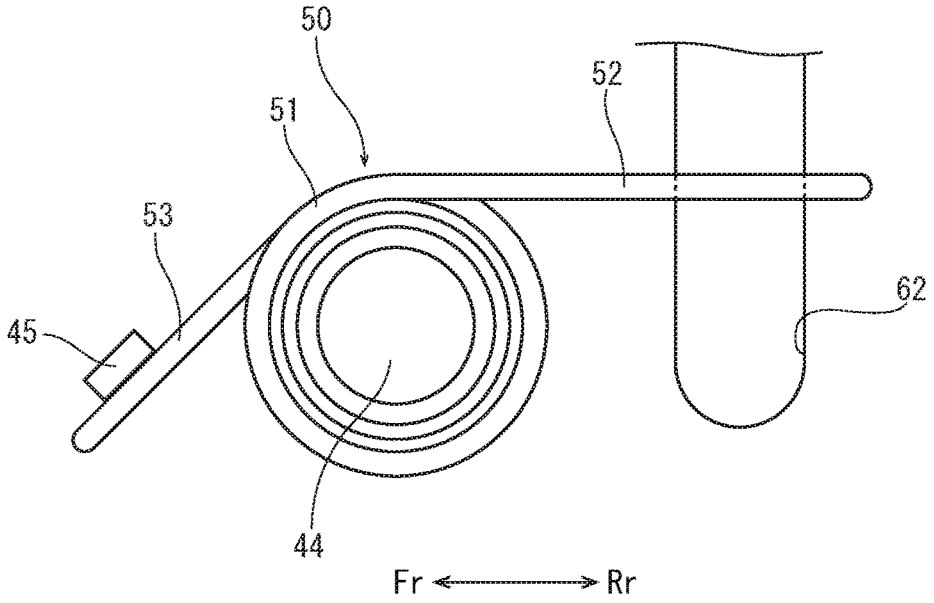
FIG. 6A is a front view showing the electrical connecting member before the photosensitive drum is attached, in the color printer according to the embodiment of the present disclosure.
Figure 6B:
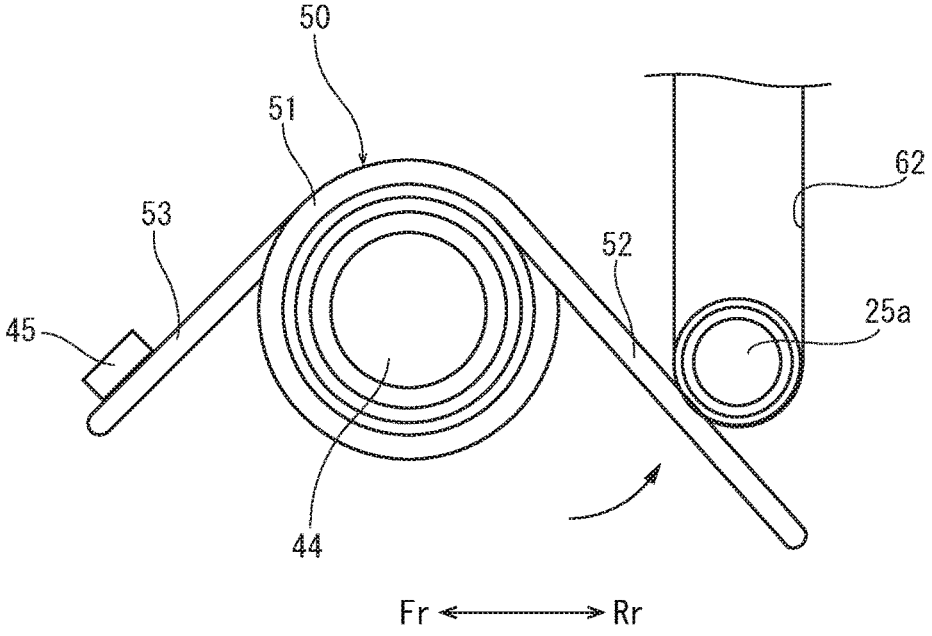
FIG. 6B is a front view showing the electrical connecting member after the photosensitive drum is attached, in the color printer according to the embodiment of the present disclosure.

Next, with reference to FIGS. 3 to 6B, the attachment section S on the right side will be described. FIG. 3 is a perspective view showing the attachment section of the right side wall and FIG. 4 is a perspective view showing the attachment section of the right side plate. FIGS. 3 and 4 show the attachment section to which the drum unit and the development unit are attached. FIGS. 5A and 5B are plan views showing the electrical connecting member, and FIGS. 6A and 6B are front views showing the electrical connecting member.

As shown in FIG. 3, in each attachment section S of the right side wall 34 of the process frame 21, an inner recess 41 recessed inward is formed. On a bottom portion of the inner recess 41, a rectangular inner cutout 43 which is cut out downward from its upper edge, a boss 44 on the front side of the inner cutout 43 and a hook 45 on the front lower side of the boss 44 are formed. Around the boss 44, an electrical connecting member 50 which electrically connects between the rotating shaft 25*a* of the photosensitive drum 25 and the right side plate 36, both of which are conductive members, is supported.

As shown in FIGS. 3, 5A to 6B, the electrical connecting member 50 is made of a conductive spring wire, and has a coil spring part 51, a first arm part 52 and a second arm part 53. The coil spring part 51 is formed by winding a center portion of the wire around a coil axis spirally. The first arm part 52 is formed by extending the wire from a first end 51*a* of the coil spring part 51 in a direction of a tangent line to the coil spring part 51. The second arm part 53 is formed by extending the wire from a second end 51*b* opposed to the first end 51*a* of the coil spring part 51 in a direction of a tangent line to the coil spring part 51. The coil spring part 51 has a length longer than a height of the boss 44. An angle between the first arm part 52 and the second arm part 53 around the coil spring part 51 is about 135°. The first arm part 52 has a length longer than a length of the second arm part 53.

The coil spring part 51 of the electrical connecting member 50 is fitted around the boss 44. The second arm part 53 is engaged with the hook 45 from the lower side. The first arm part 52 extends rearward in a substantially horizontal direction across the inner cutout 43, as shown in FIGS. 5A and 6A. In this state, elastic force in a circumferential direction around the coil axis of the coil spring part 51 is not acting and biasing force is not generated between the first arm part 52 and the second arm part 53. In addition, as shown in FIG. 5A, elastic force in an axial direction of the coil axis of the coil spring part 51 is also not acting. The first end 51*a* of the coil spring part 51 protrudes rightward from the boss 44.

As shown in FIG. 4, the right side plate 36 fastened to the outer face of the right side wall 34 of the process frame 21 with screws has an outer recess 61 recessed inward along its upper edge. The outer recess 61 is positioned corresponding to the inner recess 41 of the right side wall 34. A side face of the outer recess 61 is inclined inward toward a bottom-portion. On the bottom portion, an outer cutout 62 which is cut out downward from its upper edge and a circular opening 63 in front of the outer cutout 62 are formed. The outer cutout 62 and the opening 63 are respectively positioned corresponding to the inner cutout 43 and the boss 44 of the inner recess 41 of the right side wall 34.

With reference to FIGS. 5A and 6A, the electrical connecting member 50 is supported to the inner recess 41 of the right side wall 34. As described above, the coil spring part 51 is fitted around the boss 44, the second arm part 53 is engaged with the hook 45 and the first arm part 52 extends in the substantially horizontal direction across the inner cutout 43.

When the right side plate 36 is fastened to the outer face of the right side wall 34 with screws, as shown in FIG. 4, the outer recess 61 is overlapped on the inner recess 41 while the outer cutout 62 overlapped on the inner cutout 43 and the opening 63 overlapped on the boss 44. By overlapping the outer recess 61 on the inner recess 41, as shown in FIG. 5B, the first end 51*a* of the coil spring part 51 or the first arm part 52 is pressed inward by the bottom portion of the outer recess 61. This compresses the coil spring part 51 in the axial direction of the coil axis to produce the elastic force in the axial direction of the coil axis. By the elastic force, one or both of the first end 51*a* of the coil spring part 51 and the first arm part 52 is pressed on the bottom portion of the outer recess 61. This electrically connects between the electrical connecting member 50 and the right side plate 36. Because a contact area between the electrical connecting member 50 and the right side plate 36 is relatively large, the electrical connecting member 50 and the right side plate 36 are electrically connected stably. In addition, by compressing of the coil spring part 51, a tip end of the boss 44 is protruded through the opening 63 of the outer recess 61. As described above, the electrical connecting member 50 is supported to the process frame 21 with one or both of the first end 51*a* of the coil spring part 51 and the first arm part 52 electrically connected to the right side plate 36.

After the electrical connecting member 50 is supported to the process frame 21 as described above, the drum unit 23 of the image forming unit 20 is attached to each attachment section S.

The drum unit 23 has a lock lever 72 and a coil spring 71. The lock lever 72 is slidable in a vertical direction within a predetermined range. The coil spring 71 is interposed between the lock lever 72 and the rotating shaft 25*a* of the photosensitive drum 25. As shown in FIGS. 3 and 4, an upper end and a lower end of the coil spring 71 respectively come into contact with the lock lever 72 and the rotating shaft 25*a*. The coil spring 71 biases the rotating shaft 25*a* downward. In other words, the coil spring 71 biases the lock lever 72 upward relative to the rotating shaft 25*a*. The lock lever 72 has a hook portion (not shown) which is engaged with the process frame 21 when the drum unit 23 is attached to the attachment section S. When the drum unit 23 is attached to the attachment section S and the hook portion of the lock lever 72 is engaged with the process frame 21, the lock lever 72 is restricted from moving upward by the process frame 21 and then the coil spring 71 biases the rotating shaft 25*a* downward.

As the drum unit 23 is attached to the attachment section S from the upper side, a right end portion of the rotating shaft 25*a* of the photosensitive drum 25 is guided along the inner cutout 43 of the inner recess 41 of the right side wall 34 and the outer cutout 62 of the outer recess 61 of the right side plate 36. When the right end portion of the rotating shaft 25*a* reaches a lower end of the outer cutout 62, the photosensitive drum 25 is positioned to the right side plate 36. Because the first arm part 52 of the electrical connecting member 50 extends across the inner cutout 43 of the inner recess 41 of the right side wall 34, when the right end portion of the rotating shaft 25*a* is guided along the outer cutout 62, as shown in FIGS. 5B and 6B, the right end portion of the rotating shaft 25*a* presses the first arm part 52 of the electrical connecting member 50 downward. With the first arm part 52 pressed downward, the elastic force in the circumferential direction around the coil axis is produced in the coil spring part 51. By the elastic force, the first arm part 52 is pressed against the rotating shaft 25*a* and then the first arm part 52 is electrically connected to the rotating shaft 25*a*. Accordingly, the rotating shaft 25*a* is electrically connected to the right side plate 36 through the electrical connecting member 50 and grounded through the right side plate 36.

In addition, as shown in FIG. 3, the rotating shaft 25*a* is pressed by the first arm part 52 in an oblique upper right direction. On the other hand, the rotating shaft 25*a* is positioned to the lower end of the outer cutout 62 by a weight of the drum unit 23 and downward biasing force of the coil spring 71. Here, a spring characteristics, such as a winding number, of the coil spring part 51 of the electrical connecting member 50 is set such that an upward vertical force among the forces applied to the rotating shaft 25*a* by the first arm part 52 is smaller than a force obtained by adding the force by the weight of the drum unit 23 to the downward biasing force of the coil spring 71. In a case where the coil spring 71 which biases the rotating shaft 25*a* downward is not provided, the spring characteristics of the coil spring part 51 is set such that the upward vertical force among the forces applied to the rotating shaft 25*a* by the first arm part 52 is smaller than the force by the weight of the drum unit 23.

As described above, according to the color printer 1 of the present disclosure, the electrical connecting member 50 ensures the electrical connecting between the rotating shaft 25*a* of the photosensitive drum 25 and the right side plate 36. Although the rotating shaft 25*a* is engaged with the lower end of the outer cutout 62 of the right side plate 36 by the weight of the drum unit 23 and the downward biasing force of the coil spring 71 and comes in contact with the right side plate 36, the rotating shaft 25*a* may not come into contact with the right side plate 36 stably depending on rotation deflection of the photosensitive drum 25. In this embodiment, the rotation deflection of the photosensitive drum 25 is absorbed by the electrical connecting member 50 so that the rotating shaft 25*a* and the right side plate 36 are electrically connected stably.

Furthermore, by fitting the coil spring part 51 around the boss 44 and engaging the second arm part 53 with the hook 45, the electrical connecting member 50 is automatically supported in a posture where the first arm part 52 extends across the outer cutout 62 of the outer recess 61. Then, by fastening the right side plate 36 to the right side wall 34 by screws, the coil spring part 51 is compressed, and one or both of the first end 51*a* of the coil spring part 51 and the first arm part 52 comes in contact with the right side plate 36. In addition, when the drum unit 23 is attached, the first arm part 52 is pressed by the rotating shaft 25*a* and thus the elastic force in the circumferential direction around the coil axis is produced in the coil spring part 51. By the elastic force, the first arm part 52 comes into contact with the rotating shaft 25*a*. Accordingly, the electrical connecting member 50 can be supported easily without works for twisting the first arm part 52 and the second arm part 53 relative to the coil spring part 51 or for compressing the coil spring part 51.

In addition, the electrical connecting member 50 has a small and simple structure as with a conventional coil spring. Accordingly, the electrical connecting member 50 can be formed with a simple and inexpensive way.

In addition, the force applied to the rotating shaft 25*a* of the photosensitive drum 25 by the first arm part 52 of the electrical connecting member 50 is smaller than a force required to position the rotating shaft 25*a* of the photosensitive drum 25, that is, the force by the weight of the drum unit 23, or the force obtained by adding the force by the weight of the drum unit 23 to the downward biasing force of the coil spring 71. Therefore, a positioning precision of the photosensitive drum 25 is not varied.

While the preferable embodiment and its modified example of the electrical connecting member and the image forming apparatus of the present disclosure have been described above and various technically preferable configurations have been illustrated, a technical range of the disclosure is not to be restricted by the description and illustration of the embodiment. Further, the components in the embodiment of the disclosure may be suitably replaced with other components, or variously combined with the other components. The claims are not restricted by the description of the embodiment of the disclosure as mentioned above.

The invention claimed is:

1. An image forming apparatus comprising:

a drum unit to which an image carrier is rotatably supported around a rotating shaft;

a supporting plate to which the drum unit is detachably attached; and an electrical connecting member which electrically connects between the rotating shaft and the supporting plate, wherein the electrical connecting member includes:

a coil spring part formed by winding a wire around a coil axis, and an arm part formed by extending the wire from one end of the coil spring part, the supporting plate has a cutout formed along an attachment direction of the drum unit and guiding the rotating shaft when the drum unit is attached, and the electrical connecting member is supported such that the arm part extends horizontally across the cutout, wherein when the drum unit is attached to the supporting plate and the arm part is pressed by the rotating shaft, the electrical connecting member comes in contact with the rotating shaft with elastic force in a circumferential direction around the coil axis and comes in contact with the supporting plate with elastic force in an axial direction of the coil axis so that the rotating shaft and the supporting plate are electrically connected.

2. The image forming apparatus according to claim 1 comprising a frame main body to which the electrical connecting member is supported and the supporting plate is attached, wherein when the supporting plate is attached to the frame main body, the coil part of the electrical connecting member is compressed in the axial direction of the coil axis to produce the elastic force in the axial direction of the coil axis.

3. The image forming apparatus according to claim 2, wherein one or both of the one end of the coil spring part and the arm part comes into contact with the supporting plate with the elastic force in the axial direction of the coil axis of the coil spring part.

4. An image forming apparatus comprising:

a drum unit to which an image carrier is rotatably supported around a rotating shaft;

a supporting plate to which the drum unit is detachably attached; and an electrical connecting member which electrically connects between the rotating shaft and the supporting plate, wherein the electrical connecting member includes:

a coil spring part formed by winding a wire around a coil axis, and an arm part formed by extending the wire from one end of the coil spring part, wherein when the drum unit is attached to the supporting plate and the arm part is pressed by the rotating shaft, the electrical connecting member comes in contact with the rotating shaft with elastic force in a circumferential direction around the coil axis and comes in contact with the supporting plate with elastic force in an axial direction of the coil axis so that the rotating shaft and the supporting plate are electrically connected, wherein the drum unit is positioned to the supporting plate by force of a weight of the drum unit, the elastic force in the circumferential direction around the coil axis of the coil spring part for bringing the arm part into contact with the rotating shaft is smaller than the force of the weight of the drum unit for positioning the drum unit to the supporting plate.

5. The image forming apparatus according to claim 4 comprising a frame main body to which the electrical connecting member is supported and the supporting plate is attached, wherein when the supporting plate is attached to the frame main body, the coil part of the electrical connecting member is compressed in the axial direction of the coil axis to produce the elastic force in the axial direction of the coil axis.

6. The image forming apparatus according to claim 5, wherein one or both of the one end of the coil spring part and the arm part comes into contact with the supporting plate with the elastic force in the axial direction of the coil axis of the coil spring part.

* * * * *